US011015276B2

(12) United States Patent
Konzak

(10) Patent No.: US 11,015,276 B2
(45) Date of Patent: May 25, 2021

(54) MULTI-SENSOR SEWING MACHINE WITH AUTOMATIC NEEDLE SPEED ADJUSTMENT

(71) Applicant: HANDI QUILTER, INC., North Salt Lake, UT (US)

(72) Inventor: Gary J. Konzak, Salem, UT (US)

(73) Assignee: HANDI QUILTER, INC., North Salt Lake, UT (US)

( * ) Notice: Subject to any disclaimer, the term of this patent is extended or adjusted under 35 U.S.C. 154(b) by 116 days.

(21) Appl. No.: 16/266,759

(22) Filed: Feb. 4, 2019

(65) Prior Publication Data

US 2020/0248348 A1 Aug. 6, 2020

(51) Int. Cl.
*D05B 19/14* (2006.01)
*D05B 11/00* (2006.01)
*D05B 3/02* (2006.01)

(52) U.S. Cl.
CPC ..... *D05B 19/14* (2013.01); *D05B 3/02* (2013.01); *D05B 11/00* (2013.01)

(58) Field of Classification Search
CPC ..... D05B 1/00; D05B 19/12; D05B 19/14; D05B 3/02
See application file for complete search history.

(56) References Cited

U.S. PATENT DOCUMENTS 4,548,143 A 10/1985 Martell et al.
4,574,719 A * 3/1986 Balke ..... D05B 35/102 112/272
4,584,954 A 4/1986 Soyama et al.
4,658,741 A 4/1987 Fritz et al.
4,765,265 A 2/1988 Brownbill et al.
4,807,546 A 2/1989 Lenson et al.
5,010,833 A * 4/1991 Spencer, III ..... D05B 35/02 112/142

(Continued)

FOREIGN PATENT DOCUMENTS

JP 2002292175 A 10/2001

OTHER PUBLICATIONS

PantoiVision: Innova Innovative Quiliting Systems website dated Nov. 30, 2012; "http://innvalongarm.com/"; accessed through Internet Archive: https://archive.org/web/; accessed on Feb. 4, 2019.

*Primary Examiner* — Nathan E Durham
(74) *Attorney, Agent, or Firm* — Maschoff Brennan

(57) ABSTRACT

Multi-sensor sewing machine with automatic needle speed adjustment. In some embodiments, a sewing machine may include a frame, a needle bar, a motor, a first sensor configured to emit first electromagnetic radiation at a first frequency in order to sense relative movement of the fabric and the frame, a second sensor configured to emit second electromagnetic radiation at a second frequency, that is different from the first frequency, in order to sense relative movement of the fabric and the frame, and a processor. The processor may be configured to control a speed of the motor, determine a translational relative movement of the fabric and the frame based on the sensed relative movement of the first sensor and/or based on the sensed relative movement of the second sensor, and, in response to the determined translational relative movement, alter the speed of the motor.

24 Claims, 5 Drawing Sheets

(56) References Cited

U.S. PATENT DOCUMENTS 5,233,277 A * 8/1993 Kasig ..... D05B 69/18 112/277
5,562,057 A 10/1996 Lenson
5,662,693 A * 9/1997 Johnson ..... A61F 5/01 607/48
5,755,168 A 5/1998 Gunther et al.
6,450,110 B1 9/2002 Bruhl et al.
6,470,813 B2 10/2002 Ebata et al.
6,871,606 B2 3/2005 Schweizer
6,883,446 B2 4/2005 Koerner
6,959,657 B1 11/2005 Duval
7,082,884 B2 8/2006 Tajima et al.
7,293,512 B2 11/2007 Tajima et al.
7,325,502 B2 2/2008 Konig et al.
7,334,533 B2 2/2008 Tajima
7,370,590 B2 5/2008 Tajima et al.
7,373,891 B2 5/2008 Koerner
7,934,461 B2 5/2011 Tajima
8,074,590 B2 12/2011 Bentley
8,082,866 B2 12/2011 Hirose et al.
8,186,290 B2 5/2012 Makino et al.
8,904,947 B2 12/2014 Nishimura et al.
9,010,259 B2 4/2015 Schwarzberger
9,115,451 B2 8/2015 Konzak et al.
9,315,933 B1 4/2016 Martelli et al.
9,394,640 B2 7/2016 Bentley
9,840,797 B2 * 12/2017 Schwarzberger ..... D05B 19/14
10,100,449 B2 10/2018 Schwarzberger
2002/0083873 A1 7/2002 Sano et al.
2005/0066866 A1 3/2005 Pederzini
2005/0145149 A1 7/2005 Hooke
2006/0191452 A1 8/2006 Jo
2007/0005175 A1 * 1/2007 Konig ..... D05B 21/00 700/138
2007/0119357 A1 5/2007 Tajima
2007/0163479 A1 * 7/2007 Wentkowski ..... D05B 19/12 112/475.01
2007/0193488 A1 8/2007 Tajima et al.
2007/0263919 A1 * 11/2007 Wentkowski ..... D05B 79/00 382/141
2008/0078313 A1 4/2008 Hamajima
2010/0126400 A1 * 5/2010 Ecker ..... D05B 59/02 112/278
2010/0201561 A1 * 8/2010 Dhondt ..... G01S 13/56 342/27
2010/0294185 A1 * 11/2010 Stokes ..... D05B 11/00 112/102.5
2010/0313806 A1 12/2010 Konig et al.
2011/0290167 A1 12/2011 Li
2013/0167763 A1 * 7/2013 Cho ..... D05B 51/00 112/278
2013/0233217 A1 9/2013 Shimizu et al.
2013/0233219 A1 9/2013 Nakamura et al.
2016/0108572 A1 * 4/2016 McKinney ..... D05B 69/32 112/117
2017/0073864 A1 * 3/2017 Nakajima ..... D05B 69/00
2017/0107652 A1 * 4/2017 McKinney ..... D05B 11/00

* cited by examiner

MULTI-SENSOR SEWING MACHINE WITH AUTOMATIC NEEDLE SPEED ADJUSTMENT

BACKGROUND

Sewing machines generally function to form a row of stitches in one or more layers of fabric using a combination of thread from a spool, also known as top thread, and thread from a bobbin, also known as bottom thread. A sewing machine generally operates using a needle threaded with the top thread and a bobbin threaded with the bottom thread. Once threaded, the sewing machine generally forms a row of stitches by repeatedly reciprocating the needle through the one or more layers of fabric while simultaneously rotating a bobbin hook underneath the one or more layers of fabric.

During operation, sewing machines are generally configured either to remain stationary during operation or to be repositioned during operation. Stationary sewing machines (sometimes also referred to as sit-down sewing machines) are generally configured to remain stationary while a user repositions one or more layers of fabric in a desired direction underneath the needle. Maneuverable sewing machines (sometimes also referred to as stand-up sewing machines) are generally configured to be mounted upon a sewing machine carriage, while one or more layers of fabric are mounted in a stationary frame, to allow a user to reposition the sewing machine needle in a desired direction over the fabric.

One difficulty in operating either a stationary or maneuverable sewing machine is properly forming a row of stitches of uniform length during relative movement of the fabric and the sewing machine. For example, at a given needle speed, the speed and direction of the relative movement of the fabric and the sewing machine can affect the length of each stitch in a row of stitches. Consequently, at a given needle speed, if a user does not move a fabric at a uniform rate under a stationary sewing machine, or does not move a maneuverable sewing machine at a uniform rate over a stationary fabric, the resulting row of stitches may include stitches that are not uniform in length.

The subject matter claimed herein is not limited to embodiments that solve any disadvantages or that operate only in environments such as those described above. Rather, this background is only provided to illustrate one example technology area where some embodiments described herein may be practiced.

SUMMARY

In some embodiments, a sewing machine may include a frame, a needle bar configured to have a needle threaded with a thread, a motor configured to cause the needle bar to reciprocate the needle with respect to the frame and into and out of a fabric, a first sensor configured to emit first electromagnetic radiation at a first frequency in order to sense relative movement of the fabric and the frame, a second sensor configured to emit second electromagnetic radiation at a second frequency, that is different from the first frequency, in order to sense relative movement of the fabric and the frame, and a processor. The processor may be configured to control a speed of the motor in order to control a speed of the needle reciprocating into and out of the fabric, determine a translational relative movement of the fabric and the frame based on the sensed relative movement of the first sensor and/or based on the sensed relative movement of the second sensor, and, in response to the determined translational relative movement, alter the speed of the motor in order to alter the speed of the needle reciprocating into and out of the fabric.

In some embodiments, the first frequency may be in the range of visible light and the second frequency may be in the range of visible light. In these embodiments, the first frequency may be in the range of visible blue light while the second frequency may be in the range of visible red light.

In some embodiments, the first frequency may not be in the range of visible light and the second frequency may not be in the range of visible light.

In some embodiments, the first frequency may be in the range of visible light and the second frequency may not be in the range of visible light.

In some embodiments, the first sensor may be configured to sense relative movement of the fabric and the frame while the first sensor is positioned above the fabric, and the second sensor may be configured to sense relative movement of the fabric and the frame while the second sensor is positioned above the fabric.

In some embodiments, the first sensor may be configured to sense relative movement of the fabric and the frame while the first sensor is positioned below the fabric, and the second sensor may be configured to sense relative movement of the fabric and the frame while the second sensor is positioned below the fabric.

In some embodiments, the first sensor may be configured to sense relative movement of the fabric and the frame while the first sensor is positioned above the fabric, and the second sensor may be configured to sense relative movement of the fabric and the frame while the second sensor is positioned below the fabric.

In some embodiments, the frame of the sewing machine may be configured to remain stationary during sewing.

In some embodiments, the frame of the sewing machine may be configured to be repositioned during sewing, the sewing machine may be a long-arm quilting machine, the sewing machine may further include handle bars attached to the frame and a presser bar having a hopping foot attached thereto, and the motor may be further configured to cause the presser bar to reciprocate the hopping foot onto and off of the fabric.

In some embodiments, a sewing machine may include a frame, a needle bar configured to have a needle threaded with a thread, a motor configured to cause the needle bar to reciprocate the needle with respect to the frame and into and out of a fabric, first and third sensors configured to emit first electromagnetic radiation at a first frequency in order to sense relative movement of the fabric and the frame, second and fourth sensors configured to emit second electromagnetic radiation at a second frequency, that is different from the first frequency, in order to sense relative movement of the fabric and the frame, and a processor. The processor may be configured to control a speed of the motor in order to control a speed of the needle reciprocating into and out of the fabric, determine a translational relative movement of the fabric and the frame based on the sensed relative movement of one or more of the first sensor, the second sensor, the third sensor, or the fourth sensor, determine a rotational relative movement of the fabric and the frame based on the sensed relative movement of the first sensor and of the third sensor and/or based on the sensed relative movement of the second sensor and of the fourth sensor, and, in response to the determined translational relative movement and the determined rotational relative movement, alter the speed of the motor in order to alter the speed of the needle reciprocating into and out of the fabric.

In some embodiments, each of the first sensor and the third sensor may be configured to sense relative movement of the fabric and the frame while positioned above the fabric, and each of the second sensor and the fourth sensor may be configured to sense relative movement of the fabric and the frame while positioned above the fabric.

In some embodiments, each of the first sensor and the third sensor may be configured to sense relative movement of the fabric and the frame while positioned below the fabric, and each of the second sensor and the fourth sensor may be configured to sense relative movement of the fabric and the frame while positioned below the fabric.

In some embodiments, each of the first sensor and the second sensor may be configured to sense relative movement of the fabric and the frame while positioned above the fabric, and each of the third sensor and the fourth sensor may be configured to sense relative movement of the fabric and the frame while positioned below the fabric.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DETAILED DESCRIPTION

Figure 1A:
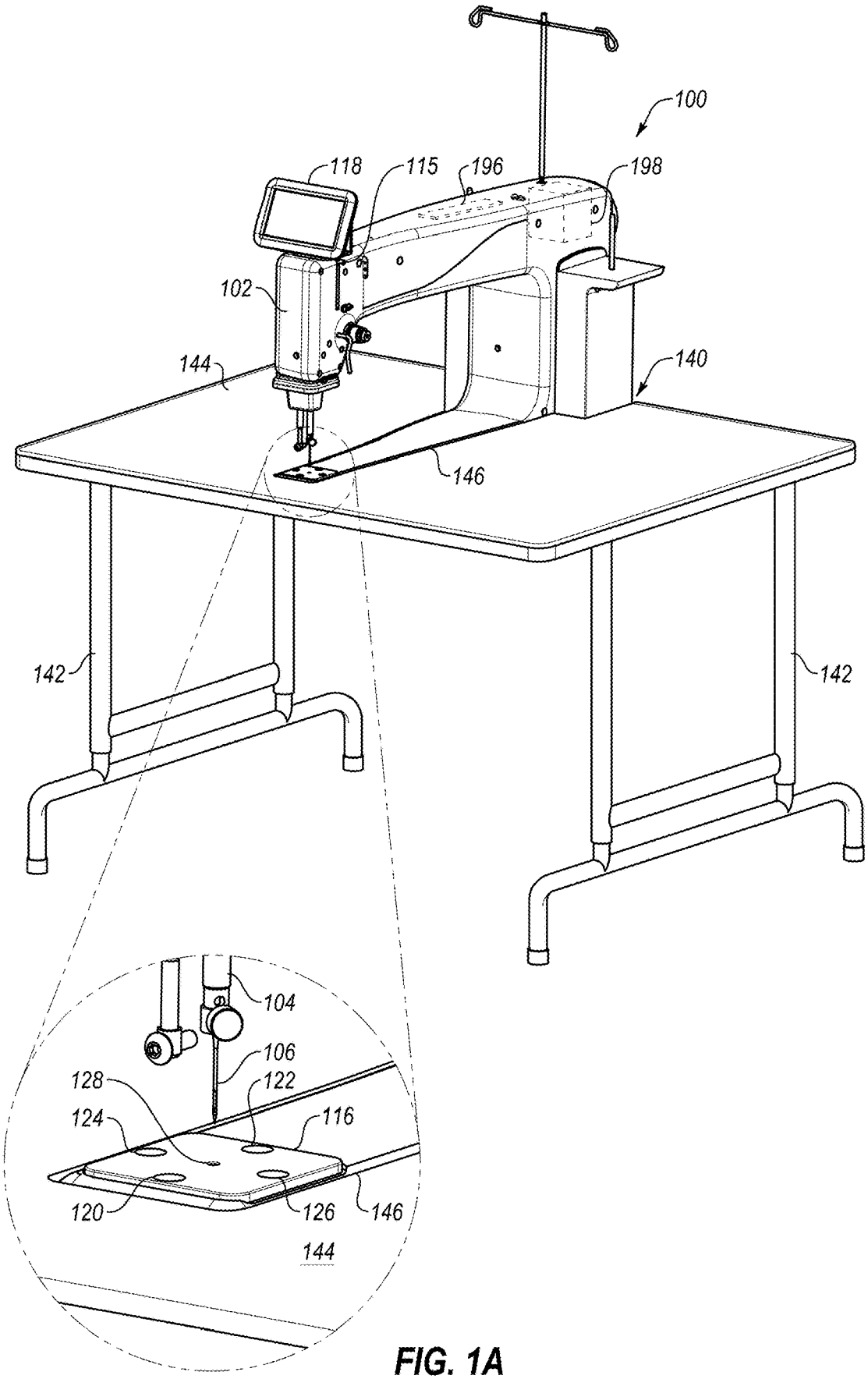
FIG. 1A is a front top perspective view of an example multi-sensor stationary sewing machine mounted on an example table.

It can be difficult for a user to properly form a row of stitches during relative movement of a fabric and a sewing machine. For example, at a given needle speed, the speed and direction of the relative movement of the fabric and the sewing machine can affect the length of each stitch in a row of stitches. Thus, at a given needle speed in a stationary sewing machine, the length of each stitch is determined by the distance the fabric has been moved since the previous stitch. Similarly, at a given needle speed in a maneuverable sewing machine, the length of each stitch is determined by the distance the sewing machine has been moved since the previous stitch. Consequently, at a given needle speed, if a user does not move a fabric at a uniform rate under a stationary sewing machine, or does not move a maneuverable sewing machine at a uniform rate over a stationary fabric, the resulting row of stitches may include stitches that are not uniform in length.

Using a conventional sewing machine, a user can attempt to achieve stitches that are uniform in length by carefully moving fabric or the sewing machine at a constant rate. However, this constant rate of movement can be very difficult to achieve. Therefore, a user of a conventional sewing machine may attempt to compensate for non-uniform rates of movement of the fabric or the sewing machine by continually adjusting the needle speed of the sewing machine, using either a hand or foot operated needle speed controller, such as a needle speed pedal. However, it can be difficult to accurately adjust the needle speed of the sewing machine, by hand or by foot, to accurately compensate for non-uniform rates of movement of the fabric or the sewing machine, thus making it difficult to achieve rows of stitches where the stitches have a uniform length.

Some embodiments disclosed herein employ a multi-sensor sewing machine with automatic needle speed adjustment. In some embodiments, a sewing machine may include a frame, a needle bar configured to have a needle threaded with a thread, and a motor configured to cause the needle bar to reciprocate the needle with respect to the frame and into and out of a fabric. In these embodiments, the sewing machine may also include multiple sensors, such as two or four sensors for example, that may be configured to emit electromagnetic radiation in order to sense relative movement of the fabric and the frame. The sewing machine may also include a processor that is configured to control a speed of the motor in order to control a speed of the needle reciprocating into and out of the fabric. The processor may also be configured to determine a translational relative movement of the fabric and the frame based on the sensed relative movement of one or more of the sensors, and or may be configured to determine a rotational relative movement of the fabric and the frame based on the sensed relative movement of two or more of the sensors. Then, in response to the determined translational relative movement and/or the determined rotational relative movement, the processor may be configured to alter the speed of the motor in order to alter the speed of the needle reciprocating into and out of the fabric. In this manner, the speed of the needle may be automatically adjusted to compensate for relative movement of the fabric and the sewing machine in order to properly form a row of stitches in the fabric where the stitches have a uniform length.

In these embodiments, one or more of the sensors of the sewing machine may be configured to emit electromagnetic radiation at a first frequency while one or more of the other sensors of the sewing machine may be configured to emit electromagnetic radiation at a second frequency that is different from the first frequency. In these embodiments, emitting light at different frequencies may avoid deficiencies in single-frequency embodiments.

For example, where a first sensor of the sewing machine is configured to emit electromagnetic radiation at a first frequency in the range of visible blue light (a "blue light sensor"), the first sensor may be unable to detect translational relative movement of the fabric where the color of the fabric is blue. To resolve this deficiency, a second sensor of the sewing machine may be configured to emit electromagnetic radiation at a second frequency in the range of visible red light (a "red light sensor"). Unlike the blue light sensor, the red light sensor may be able to detect translational relative movement of the blue fabric. Similarly, where the color of the fabric is red, the blue light sensor may be able to detect translational relative movement of the red fabric. Therefore, including both a red light sensor and a blue light sensor in the sewing machine may enable one sensor to continue to properly detect translational relative movement of the red or blue fabric even when the other sensor is unable to properly detect translational relative movement of the red or blue fabric.

Continuing with the above example, since two sensors may be required to sense rotational relative movement (in contrast to translational relative movement which may only require a single sensor), the sewing machine may include two blue light sensors and two red light sensors. Including two blue light sensors and two red light sensors may result in the two blue light sensors being able to detect relative movement of a red fabric, even though the two red light sensors are unable to detect this relative movement of the red fabric. Similarly, including two blue light sensors and two red light sensors may result in the two red light sensors being able to detect relative movement of a blue fabric, even though the two blue light sensors are unable to detect this relative movement of the blue fabric. Therefore, including two red light sensors and two blue light sensors in the sewing machine may enable one pair of sensors to continue to properly detect rotational relative movement of the red or blue fabric even when the other pair of sensors is unable to properly detect rotational relative movement of the red or blue fabric.

In the example above and elsewhere herein, it is understood that the first frequency being in the range of visible blue light and the second frequency being in the range of visible red light is for illustration purposes only, and any other frequencies may instead be employed. For example, other frequencies in the ranges of other visible colors of light may be employed. Further, other frequencies not in the ranges of visible light also may be employed.

Figure 1B:
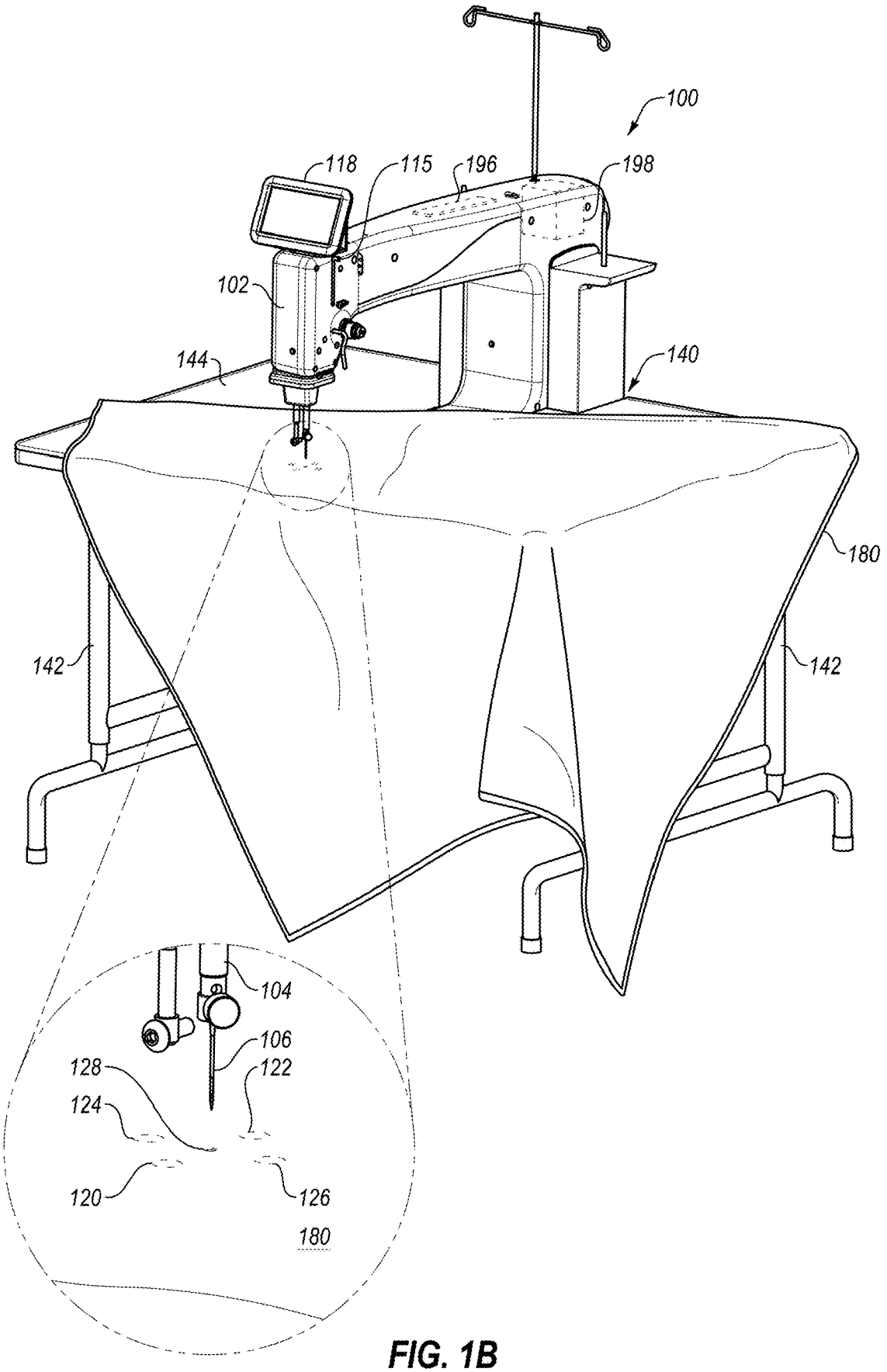
FIG. 1B is a front top perspective view of the example multi-sensor stationary sewing machine mounted on the example table of FIG. 1A with a fabric positioned thereon.

FIG. 1A is a front top perspective view of an example multi-sensor stationary sewing machine 100 mounted on an example table 140. FIG. 1B is a front top perspective view of the example multi-sensor stationary sewing machine 100 mounted on the example table 140 with a fabric 180 positioned thereon.

The example sewing machine 100 of FIGS. 1A and 1B is specialized for quilting and is known as a long-arm quilting machine. A long-arm quilting machine may be distinguished from other types of sewing or quilting machines because of the "long-arm" configuration of the machine. Quilting typically involves stitching together multiple layers of fabric to form a quilt. A quilt typically includes a layer of batting sandwiched in between upper and lower layers of fabric. For example, prior to being sewn into a quilt, the fabric 180 may initially be multiple layers of fabric tacked together, such as a batting fabric tacked between a backing fabric and a quilt-top fabric. Although the example sewing machine 100 of FIGS. 1A and 1B is a long-arm quilting machine, it is understood that the sewing machine 100 of FIGS. 1A and 1B is only one of countless stationary sewing machines in which the example automatic needle speed adjustments disclosed herein may be employed. The scope of the example automatic needle speed adjustments disclosed herein is therefore not intended to be limited to employment in any particular stationary sewing machine.

As disclosed in FIGS. 1A and 1B, the sewing machine 100 may include a frame 102 which houses various internal components of the sewing machine 100, such as a processor 196 and a motor 198. The sewing machine 100 may also include a needle bar 104 that is configured to have a needle 106 attached thereto. The motor 198 may be configured to cause the needle bar 104 to reciprocate the needle 106 with respect to the frame 102 and into and out of one or more layers of fabric, such as the fabric 180. A top thread from a spool (not shown) may be passed through various thread guides, including a take-up lever 115, until finally the top thread is threaded through the eye of the needle 106. Although not shown in FIGS. 1A and 1B, it is understood that the sewing machine 100 may also include a bobbin case configured to hold a bobbin that is wound with bottom thread, and a bobbin hook (which may also be driven by the motor 198 or another synchronized motor), all generally positioned in the frame 102 underneath a needle plate 116.

To facilitate use of the sewing machine 100 by a user, the sewing machine 100 may be mounted on the table 140. The table 140 may include legs 142 and a table top 144. The table top 144 may include a recess 146 into which the sewing machine 100 may be mounted such that the top surface of the needle plate 116 is generally flush with the top surface of table top 144. When mounted to the table 140, the sewing machine 100 is configured as a stationary sewing machine (sometimes also referred to as a sit-down sewing machine) in which the sewing machine 100 is configured to remain stationary during operation while a user repositions the one or more layers of fabric, such as the fabric 180, in a desired direction underneath the needle 106.

As disclosed in FIGS. 1A and 1B, the sewing machine 100 may further include two or more sensors. For example, the sewing machine 100 may include a first sensor 120, a second sensor 122, a third sensor 124, and a fourth sensor 126. Each of the sensors 120-126 may be optical sensors, motion sensors, or any type of sensor capable of monitoring the relative movement of the fabric 180 and the frame 102 of the sewing machine 100. For example, each of the sensors 120-126 may be an optical sensor that operates by using a tiny camera that takes upward of 1,500 pictures every second. The processor 196 may then compare the images with one another such that over a sequence of images it can be determined when movement occurs. An example optical sensor may be similar or identical to the optical sensor used in an optical mouse of a desktop computer.

In some embodiments, each of the sensors 120-126 may sense the direction and speed of the relative movement of the fabric 180 and the frame 102. This data may then be communicated to the processor 196. The processor 196 may then determine the speed and direction of movement of the fabric 180. The processor 196 may then convert the movement information into a format readable by the motor 198 to enable the motor 198 to operate at a certain rate controlling the up and down speed of the reciprocating needle 106. In other words, the motor 198 may drive the cycle frequency of the reciprocating needle 106. In order to provide a uniform stitch length, as the velocity of the fabric 180 relative to the frame 102 of the sewing machine 100 is increased, the speed of motor 198 and the cycle frequency of reciprocating needle 106 may likewise be increased. Similarly, as the velocity and distance moved of the fabric 180 is decreased, the speed of motor 198 and the cycle frequency of the reciprocating needle 106 may likewise be decreased.

In some embodiments, the fabric 180 may be rotated about an axis that aligns either on or more closely to the first sensor 120 or the second sensor 122. In these embodiments, the sensor that is located either close to or at the center of the axis of rotation may not sense that there is any movement by the fabric 180 or sense less movement of the fabric 180 than the other sensor, but the other sensor will be able to sense the movement of the fabric 180. The processor 196 may determine, based on the difference between the information received from the first sensor 120 and the second sensor 122, the rate of rotation of the fabric 180 and, in response, adjust the speed of the motor 198 and the reciprocating needle 106 accordingly in order to maintain a uniform stitch length.

This may be performed by the processor 196 continuously comparing the data received from the two sensors. The data received from the two sensors may be added together to produce an improved response to the movement of the fabric 180. If the sum of the sensed movement of the two sensors is a positive or negative number, then it may be determined that the fabric 180 is moving in one linear direction. If the sensed movement is in opposite directions because of rotation of the fabric 180, the sum of the two sensors may cancel each other out.

In some embodiments, if the fabric 180 is rotating and moving translationally relative to the frame 102, one of the first sensor 120 and the second sensor 122 may misread or missense some or all of the movement of the fabric 180. For example, where the first sensor 120 is a blue light sensor and the second sensor 122 is a red light sensor, and the fabric 180 is a blue fabric, the first sensor 120 may be unable to detect translational relative movement of the blue fabric, while the second sensor 122 is able to detect translational relative movement of the blue fabric. In this example, the processor 196 may receive correct information from the second sensor 122 while the first sensor 120 may either not send any information or may send information that is incorrect. The processor 196 may adjust the information from the first sensor 120 (that either provides no information or incorrect information) in conjunction with the information from the second sensor 122 (that is sensing correctly) to create correct movement information of the fabric 180. This may be accomplished by the processor 196 detecting that the first sensor 120 is either no longer sending movement information or is updating with invalid movement information. The processor 196 may then assume that the first sensor 120 is no longer sensing the fabric 180 and may double the information from the second sensor 122 that is still providing information. The processor 196 may then communicate with the motor 198 and adjust the reciprocating speed of the reciprocating needle 106 to produce a uniform stitch length.

In some embodiments, the processor 196 may thus vary the cycle frequency of the reciprocating needle 106 corresponding to the user imparted velocity, distance and rotation moved of the fabric 180 relative to the frame 102 of the sewing machine 100. Each of the sensors 120-126 may be configured to stream relative position data of the fabric 180 and the frame 102 to the processor 196. The processor 196 may then manipulate the streamed data to account for translational relative movement and/or rotational relative movement, as well as to account for misreading or missensing by one or more of the sensors. Once the translations, rotations, and/or misreads are accounted for, the processor 196 may create two simulated encoder outputs to represent movement in X and Y Cartesian coordinates. XA/XB may be the equivalent X encoder signals and YA/YB may be the equivalent Y encoder signals. These signals may be provided to the motor 198 (such as to a controller of a motor 198) that is operating the needle bar 104 to maintain uniform stitch length.

These two sets of channels may allow the processor 196 to determine an array of information. First, the channels may provide a means to detect the relative position of the fabric 180 and the frame 102. The total number of output pulses in the X and Y direction may be recorded. The two channels may allow the processor 196 to add or subtract position values. The total sum of pulses in the X and Y direction from the encoder multiplied by a calibration factor may give the relative position of the fabric 180. The calibration factor may be a value equal to pulses per linear distance for a given system. Since the pulses XA/XB and YA/YB may be outputs created from the reading of the sensors 120-126, the frequency of the pulses may be controlled by how fast the fabric 180 is moved relative to (e.g., over or under) the sensors 120-126. Second, these channels may provide a means to detect the velocity of the frame 102 or the fabric 180. The sensors 120-126 may be controlled by the processor 196 using the Pythagorean Theorem to manipulate data pulses of the sensors 120-126 containing movement in the X and Y direction. A sample of the pulses for the X and Y direction may be taken over a relatively short period of time. The square root of the sum of the squares of the total pulses in the X direction and the total pulses in the Y direction multiplied by the calibration factor may give a linear distance. The linear distance may be divided by the period of time in which the sample pulses were taken. This value may be the velocity of the sensed fabric 180 over the period of time. It should be noted that in order to detect velocity, it may not be necessary to be able to detect position. In other words, all data pulses, XA/XB and YA/YB, may be additions. In some embodiments, only a consistent stream of pulses that varies based on motion of the fabric 180 may be needed.

These two sets of channels may further allow other computer systems to manipulate the data in other ways. For example, the position data can be calculated and tracked on a Cartesian coordinate system to maintain a cursor position on a visual display screen (such as on a display 118). In this example, the movement information of the fabric 180 relative to the needle 106 may be tracked. Based on the tracked movement, a cursor on a screen may move proportionally in the same direction and speed as to the sensed movement of the fabric 180.

As disclosed in FIGS. 1A and 1B, the first sensor 120 and the second sensor 122 may be positioned on opposite sides of an opening 128 in the needle plate 116 that is configured to receive the needle 106 as it reciprocates up and down during operation of the sewing machine 100. Similarly, the third sensor 124 and the fourth sensor 126 may also be positioned on opposite sides of the opening 128 in the needle plate 116. Although the sensors 120-126 are illustrated in FIGS. 1A and 1B as being positioned on the needle plate 116 so as to be below the fabric 180, it is understood that the sensors 120-126 may be positioned elsewhere on the sewing machine 100 or on the table 140 and/or may be positioned such that some or all of the sensors 120-126 are positioned above the fabric 180. For example, the sensors 120-126 may be positioned on the frame 102 above the needle bar 104 so that the sensors 120-126 are positioned above the fabric 180. In another example, the first sensor 120 and the third sensor 124 may be positioned below the fabric 180, such as on the needle plate 116 or on another part of the frame 102 or table 140 below the fabric 180, while the second sensor 122 and the fourth sensor 126 are positioned on the frame 102 above the needle bar 104 so that the second sensor 122 and the fourth sensor 126 are positioned above the fabric 180. In yet another example, the first sensor 120 and the second sensor 122 may be positioned to be above the fabric 180, while the third sensor 124 and the fourth sensor 126 may be positioned to be below the fabric 180.

The sensors 120-126 may be configured to emit electromagnetic radiation in order to sense relative movement of the fabric 180 and the frame 102. For example, as a user repositions the fabric 180 under the frame 102 of the sewing machine 100, the sensors 120-126 may be configured to emit electromagnetic radiation in order to sense translational relative movement, and/or rotational relative movement, of the fabric 180 and the frame 102. Further, the sensors

120-126 may be configured to emit electromagnetic radiation at different frequencies in order to avoid deficiencies in single-frequency embodiments, such as deficiencies due to a color of visible light emitted by one or more of the sensors 120-126 matching a color of the fabric 180 and therefore making it difficult for the sensor to sense motion of the fabric 180. For example, the first sensor 120 and the third sensor 124 may be configured to emit first electromagnetic radiation at a first frequency (e.g., in the range of blue visible light, or "blue light sensors") in order to sense relative movement of the fabric 180 and the frame 102, while the second sensor 122 and the fourth sensor 126 may be configured to emit second electromagnetic radiation at a second frequency (e.g., in the range of red visible light, or "red light sensors") in order to sense relative movement of the fabric 180 and the frame 102. In this example, including multiple red light sensors and multiple blue light sensors in the sewing machine 100 may enable the first sensor 120 and the third sensor 124 (e.g., the blue light sensors) to continue to properly detect relative movement of the fabric 180 and the frame 102 where the fabric 180 is red, even when the second sensor 122 and the fourth sensor 126 (e.g., the red light sensors) are unable to properly detect relative movement of the fabric 180 and the frame 102 due to the fabric being red.

Then, a processor 196 (which may be internal or external to the sewing machine 100, such as internal to the display 118, for example) may be configured to control a speed of the motor 198 in order to control a speed of the needle 106 reciprocating into and out of the fabric 180. The processor 196 may also be configured to determine a translational relative movement of the fabric 180 and the frame 102 based on the sensed relative movement of one or more of the sensors 120-126, and or may be configured to determine a rotational relative movement of the fabric 180 and the frame 102 based on the sensed relative movement of two or more of the sensors 120-126. Then, in response to the determined translational relative movement and/or the determined rotational relative movement, the processor 196 may also be configured to alter the speed of the motor 198 in order to alter the speed of the needle 106 reciprocating into and out of the fabric 180. In this manner, the speed of the needle 106 may be automatically adjusted to compensate for relative movement of the fabric 180 and the frame 102 in order to properly form a row of stitches in the fabric 180 where the stitches have a uniform length.

Figure 2A:
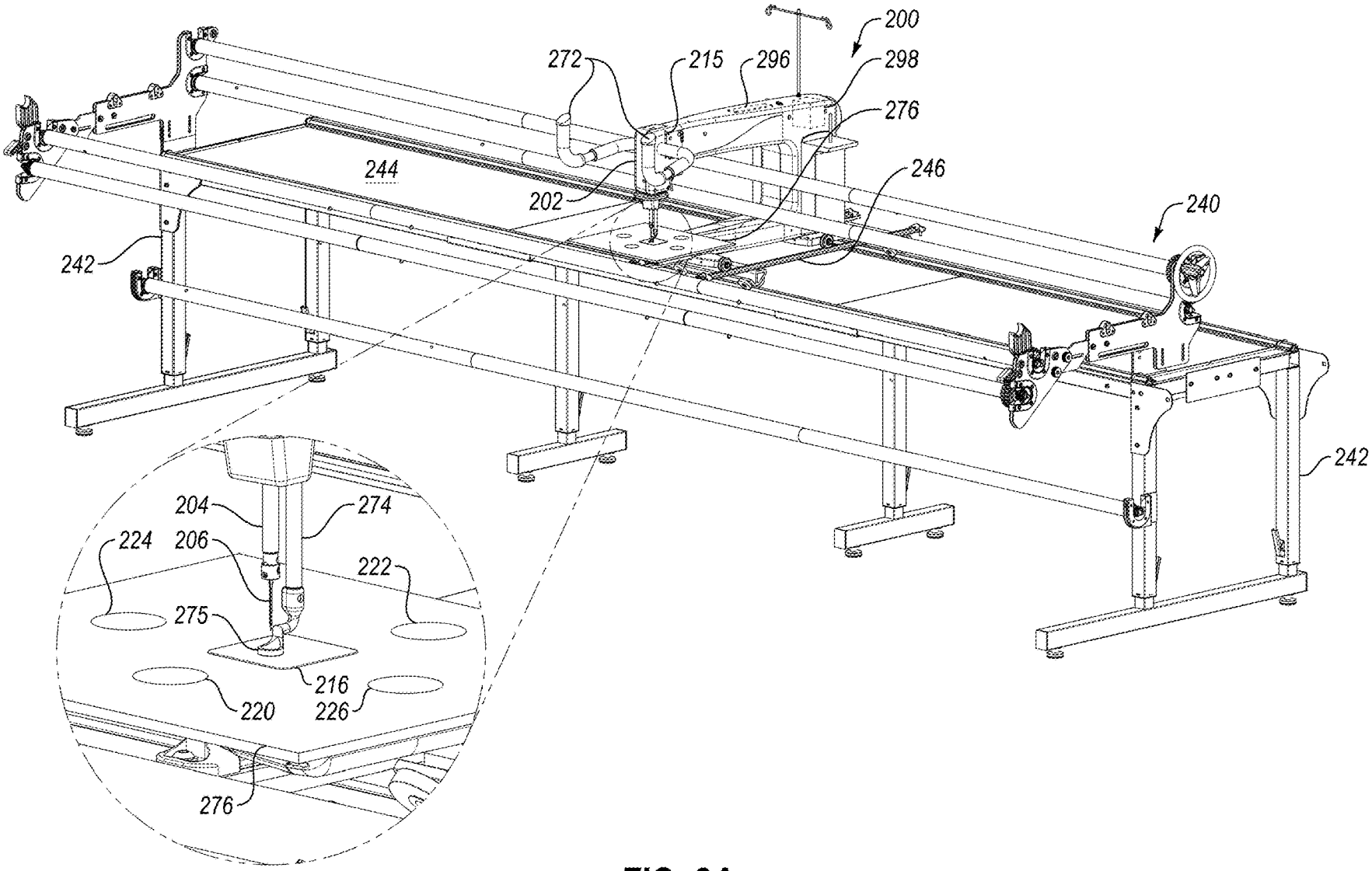
FIG. 2A is a front top perspective view of an example multi-sensor maneuverable sewing machine mounted on an example fabric frame.
Figure 2B:
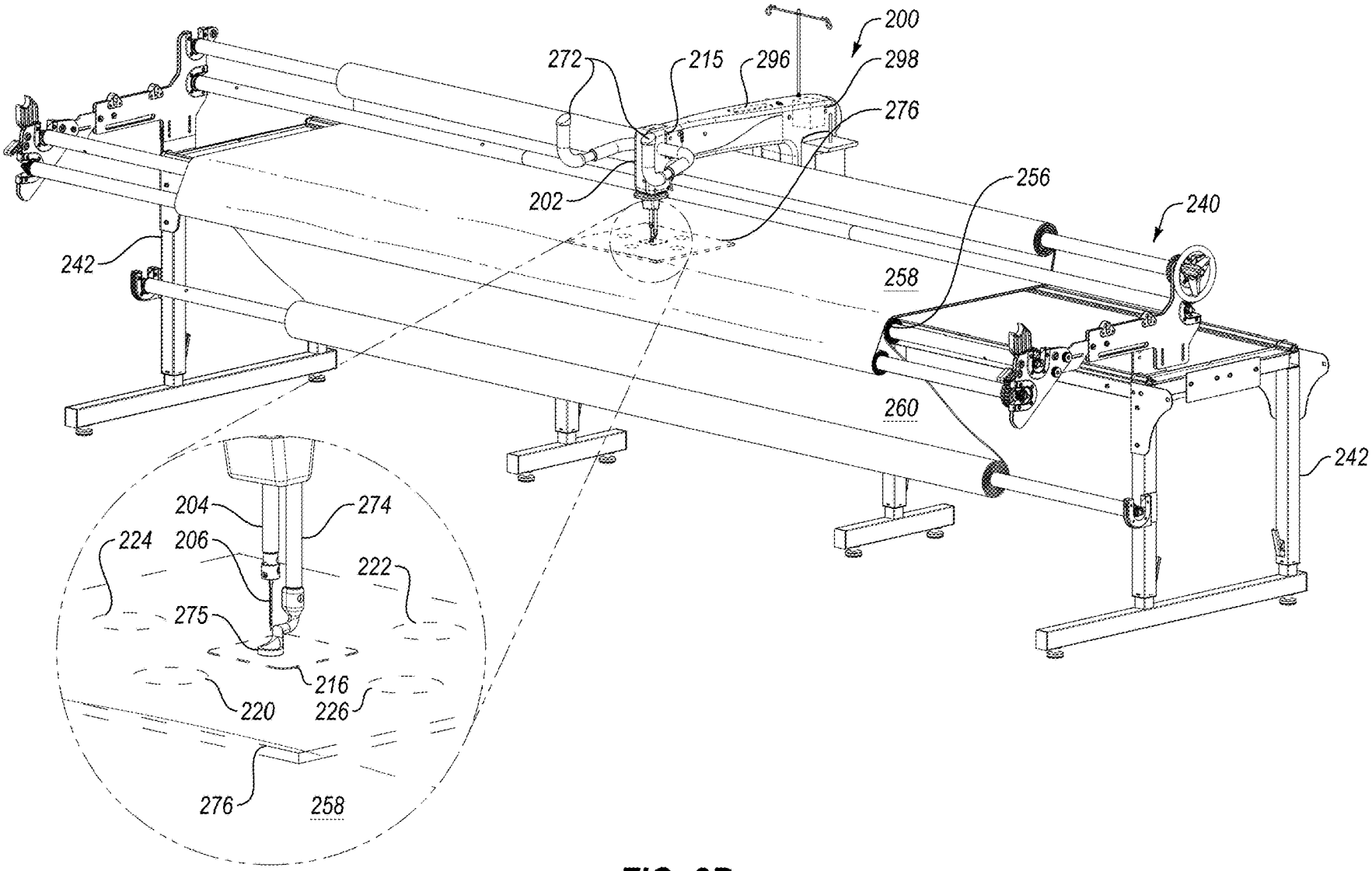
FIG. 2B is a front top perspective view of the example multi-sensor maneuverable sewing machine mounted on the example fabric frame of FIG. 2A with layers of fabric spooled thereon.

FIG. 2A is a front top perspective view of an example multi-sensor maneuverable sewing machine 200 mounted on an example fabric frame 240. FIG. 2B is a front top perspective view of the example multi-sensor maneuverable sewing machine 200 mounted on the example fabric frame 240 with layers of fabric spooled thereon. Many aspects of the sewing machine 200 are similar to the sewing machine 100, and therefore will not be repeated in this description.

The maneuverable sewing machine 200 of FIGS. 2A and 2B, like the sewing machine 100 of FIGS. 1A and 1B, is also a long-arm quilting machine. But unlike the sewing machine 100 which is stationary, the sewing machine 200 is maneuverable. Although the example maneuverable sewing machine 200 of FIGS. 2A and 2B is a maneuverable long-arm quilting machine, it is understood that the sewing machine 200 of FIGS. 2A and 2B is only one of countless maneuverable sewing machines in which the example automatic needle speed adjustments disclosed herein may be employed. The scope of the example automatic needle speed adjustments disclosed herein is therefore not intended to be limited to employment in any particular maneuverable sewing machine.

As disclosed in FIGS. 2A and 2B, the sewing machine 200 may include a frame 202 which houses various internal components of the sewing machine 200, such as a processor 296 and a motor 298. The sewing machine 200 may also include a needle bar 204 that is configured to have a needle 206 attached thereto and a presser bar 274 having a hopping foot 275 attached thereto, along with handlebars 272 attached to the frame 202, and a ruler base 276, among other components. The motor 298 may be configured to cause the needle bar 204 to reciprocate the needle 206 with respect to the frame 202 and into and out of one or more layers of fabric, such as a backing fabric 256, a quilt-top fabric 258, and a batting fabric 260. Simultaneously, the motor 298 may also be configured to cause the presser bar 274 to reciprocate the hopping foot 275 onto and off of the fabric 256-260, to alternate between holding the one or more layers of the fabric 256-260 in place during the finalization of each stitch and releasing the one or more layers of the fabric 256-260 to facilitate the movement of the sewing machine 200 relative to the fabric 256-260 between each stitch. A top thread from a spool (not shown) may be passed through various thread guides, including a take-up lever 215, until finally the top thread is threaded through the eye of the needle 206. Although not shown in FIGS. 2A and 2B, it is understood that the sewing machine 200 may also include a bobbin case configured to hold a bobbin that is wound with bottom thread, and a bobbin hook (which may also be driven by the motor 298 or another synchronized motor), all generally positioned in the frame 202 underneath a needle plate 216.

To facilitate use of the sewing machine 200 by a user, the sewing machine 200 may be mounted on a fabric frame 240. The fabric frame 240 may include legs 242 and a table top 244. A sewing machine carriage 246 may be mounted on the table top 244 and the sewing machine 200 may be mounted in the sewing machine carriage 246. This configuration may allow a user to grasp the handlebars 272 that are attached to the frame 202 of the sewing machine 200 and then reposition the sewing machine 200 while sewing over the one or more layers of fabric (such as the backing fabric 256, the quilt-top fabric 258, and the batting fabric 260) spooled on spools of the fabric frame 240. When mounted to the fabric frame 240, the sewing machine 200 is configured as a maneuverable sewing machine (sometimes also referred to as a stand-up sewing machine) in which the user repositions the needle 206 of the sewing machine 200 in a desired direction over one or more layers of fabric, such as the fabric 256-260, which remain stationary due to being mounted in the fabric frame 240.

As disclosed in FIGS. 2A and 2B, the sewing machine 200 may further include two or more sensors. For example, the sewing machine 200 may include a first sensor 220, a second sensor 222, a third sensor 224, and a fourth sensor 226, which may be similar to the sensors 120-126 of FIGS. 1A and 1B. As disclosed in FIGS. 2A and 2B, the first sensor 220 and the second sensor 222 may be positioned on the ruler base 276 on opposite sides of the needle plate 216. Similarly, the third sensor 224 and the fourth sensor 226 may also be positioned on the ruler base 276 on opposite sides of the needle plate 216. Although the sensors 220-226 are illustrated in FIGS. 2A and 2B as being positioned on the ruler base 276 so as to be below the fabric 256-260, it is understood that the sensors 220-226 may be positioned elsewhere on the sewing machine 200 or the fabric frame 240, and/or may be positioned such that some or all of the sensors 220-226 are positioned above the fabric 256-260.

The sensors 220-226 may be configured to emit electromagnetic radiation in order to sense relative movement of the fabric 256-260 and the frame 202, and may be configured to emit electromagnetic radiation at different frequencies in order to avoid deficiencies in single-frequency embodiments, as discussed elsewhere herein. Then, the processor 296 (which may be internal or external to the sewing machine 200, for example) may be configured to control a speed of the motor 298 in order to control a speed of the needle 206 reciprocating into and out of the fabric 256-260. The processor 296 may also be configured to determine a translational relative movement of the fabric 256-260 and the frame 202 based on the sensed relative movement of one or more of the sensors 220-226, and/or may be configured to determine a rotational relative movement of the fabric 256-260 and the frame 202 based on the sensed relative movement of two or more of the sensors 220-226. Then, in response to the determined translational relative movement and/or the determined rotational relative movement, the processor 296 may also be configured to alter the speed of the motor 298 in order to alter the speed of the needle 206 reciprocating into and out of the fabric 256-260. In this manner, the speed of the needle 206 may be automatically adjusted to compensate for relative movement of the fabric 256-260 and the frame 202 in order to properly form a row of stitches in the fabric 256-260 where the stitches have a uniform length.

Figure 3:
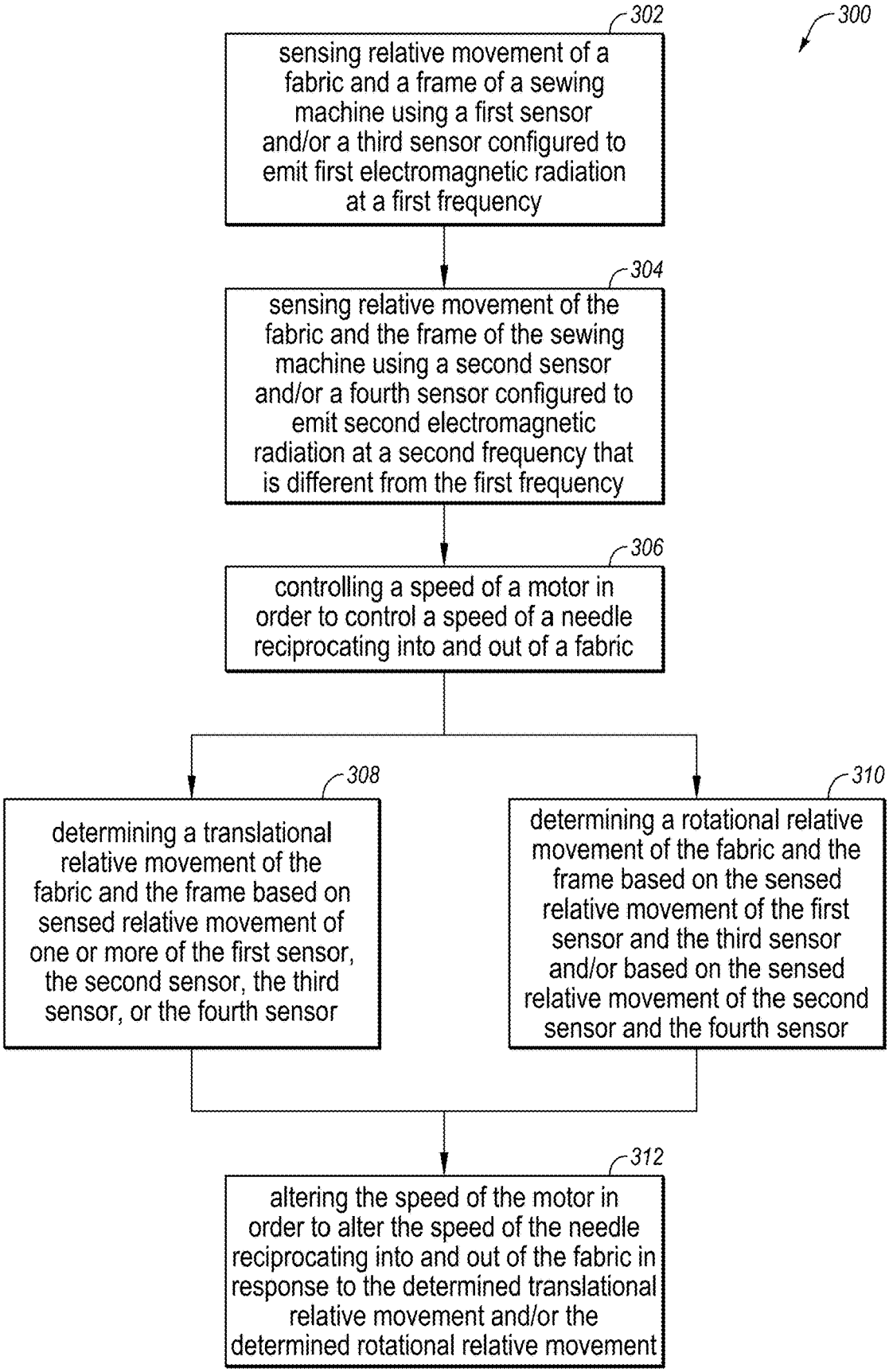
FIG. 3 is a flowchart of an example method for employing a multi-sensor sewing machine to automatically adjust needle speed.

FIG. 3 is a flowchart of an example method 300 for employing a multi-sensor sewing machine to automatically adjust needle speed. The method 300 may be performed, in some embodiments, by one or more applications, devices, or systems, such as by the processor 196 associated with the sewing machine 100 of FIGS. 1A and 1B, or by the processor 296 associated with the sewing machine 200 of FIGS. 2A and 2B. In these and other embodiments, the method 300 may be performed by one or more processors based on one or more computer-readable instructions stored on one or more non-transitory computer-readable media, and in electronic communication (wired or wireless) with one or more sensors and one or more motors. The method 300 will now be described in connection with FIGS. 1A, 1B, 2A, 2B, and 3.

The method 300 may include, at action 302, sensing relative movement of a fabric and a frame of a sewing machine using a first sensor and/or a third sensor configured to emit first electromagnetic radiation at a first frequency. In a first example, the first sensor 120 and the third sensor 124 may sense, at action 302, relative movement of the fabric 180 and the frame 102 of the sewing machine 100, and these sensors may be configured to emit first electromagnetic radiation at a first frequency in the range of visible blue light. Alternatively, in a second example, the first sensor 220 and the third sensor 224 may sense, at action 302, relative movement of the fabric 256-260 and the frame 202 of the sewing machine 200, and these sensors may be configured to emit first electromagnetic radiation at a first frequency in the range of visible blue light.

The method 300 may include, at action 304, sensing relative movement of the fabric and the frame of the sewing machine using a second sensor and/or a fourth sensor configured to emit second electromagnetic radiation at a second frequency that is different from the first frequency. Continuing with the first example from above, the second sensor 122 and the fourth sensor 126 may sense, at action 304, relative movement of the fabric 180 and the frame 102 of the sewing machine 100, and these sensors may be configured to emit second electromagnetic radiation at a second frequency in the range of visible red light. Alternatively, continuing with the second example from above, the second sensor 222 and the fourth sensor 226 may sense, at action 304, relative movement of the fabric 256-260 and the frame 202 of the sewing machine 200, and these sensors may be configured to emit second electromagnetic radiation at a second frequency in the range of visible red light.

In either the first example or the second example from above, including multiple red light sensors and multiple blue light sensors in the sewing machine may enable the first sensor and the third sensor (e.g., the blue light sensors) to continue to properly detect relative movement of the fabric and the frame where the fabric is red, even when the second sensor and the fourth sensor (e.g., the red light sensors) are unable to properly detect relative movement of the fabric and the frame due to the fabric being red.

The method 300 may include, at action 306, controlling a speed of a motor in order to control a speed of a needle reciprocating into and out of a fabric. Continuing with the first example from above, a processor 196 of the sewing machine 100 may control, at action 306, a speed of a motor 198 of the sewing machine 100 in order to control a speed of the needle 106 reciprocating into and out of the fabric 180. Alternatively, continuing with the second example from above, a processor 296 of the sewing machine 200 may control, at action 306, a speed of a motor 298 of the sewing machine 200 in order to control a speed of the needle 206 reciprocating into and out of the fabric 256-260.

The method 300 may include, at action 308, determining a translational relative movement of the fabric and the frame based on sensed relative movement of one or more of the first sensor, the second sensor, the third sensor, or the fourth sensor. Continuing with the first example from above, a processor 196 of the sewing machine 100 may determine, at action 308, a translational relative movement of the fabric 180 and the frame 102 based on sensed relative movement of one or more of the first sensor 120, the second sensor 122, the third sensor 124, or the fourth sensor 126. Alternatively, continuing with the second example from above, a processor 196 of the sewing machine 200 may determine, at action 308, a translational relative movement of the fabric 256-260 and the frame 202 based on sensed relative movement of one or more of the first sensor 220, the second sensor 222, the third sensor 224, or the fourth sensor 226.

The method 300 may include, at action 310, determining a rotational relative movement of the fabric and the frame based on the sensed relative movement of the first sensor and the third sensor and/or based on the sensed relative movement of the second sensor and the fourth sensor. Continuing with the first example from above, a processor 196 of the sewing machine 100 may determine, at action 310, a rotational relative movement of the fabric 180 and the frame 102 based on the sensed relative movement of the first sensor 120 and the third sensor 124 and/or based on the sensed relative movement of the second sensor 122 and the fourth sensor 126. Alternatively, continuing with the second example from above, a processor 296 of the sewing machine 200 may determine, at action 310, a rotational relative movement of the fabric 256-260 and the frame 202 based on the sensed relative movement of the first sensor 220 and the third sensor 224 and/or based on the sensed relative movement of the second sensor 222 and the fourth sensor 226.

The method 300 may include, at action 312, altering the speed of the motor in order to alter the speed of the needle reciprocating into and out of the fabric in response to the determined translational relative movement and/or the determined rotational relative movement. Continuing with the first example from above, a processor 196 of the sewing machine 100 may alter, at action 312, the speed of the motor 198 in order to alter the speed of the needle 106 reciprocating into and out of the fabric 180 in response to the determined translational relative movement and/or the determined rotational relative movement. Alternatively, continuing with the second example from above, a processor 296 of the sewing machine 200 may alter, at action 310, the speed of the motor 298 in order to alter the speed of the needle 206 reciprocating into and out of the fabric 256-260 in response to the determined translational relative movement and/or the determined rotational relative movement.

The method 300 may be employed in a multi-sensor sewing machine, such as in the multi-sensor stationary sewing machine 100 or in the multi-sensor maneuverable sewing machine 200, to automatically adjust needle speed to compensate for non-uniform relative movement of a fabric and the frame of the sewing machine, in order to properly form a row of stitches in the fabric where the stitches have a uniform length. In some embodiments, the method 300 may be employed with sensors of the sewing machine that are configured to emit electromagnetic radiation at two different frequencies, which may avoid deficiencies in single-frequency embodiments. For example, by including both a red light sensor and a blue light sensor in a sewing machine, the method 300 may enable one sensor or pair of sensors to continue to properly detect translational or rotational relative movement of the fabric and the frame even when the other sensor is unable to properly detect translational or rotational relative movement of the fabric and the frame, due to, for example, a color of visible light emitted by one or more of the sensors matching a color of the fabric.

Although the example sewing machines 100 and 200 disclosed herein each include four sensors, it is understood that some embodiments may include two sensors, three sensors, or more than four sensors. Further, although the example sewing machines 100 and 200 disclosed herein include sensors that are configured to emit electromagnetic radiation at two different frequencies, it is understood that some embodiments may include sensors that are configured to emit electromagnetic radiation at more than two different frequencies. Further, although frequencies in the range of visible red light and visible blue light are discussed as example frequencies herein, it is understood that other frequencies may be employed, both in the range of various colors of visible light, as well as in various frequencies not in the range of visible light.

The embodiments described herein may include the use of a special-purpose or general-purpose computer, including various computer hardware or software modules, as discussed in greater detail below.

Embodiments of the motors, controllers, and sensors described herein may be implemented using non-transitory computer-readable media for carrying or having computer-executable instructions or data structures stored thereon. Such computer-readable media may be any available media that may be accessed by a general-purpose or special-purpose computer. By way of example, and not limitation, such computer-readable media may include non-transitory computer-readable storage media including RAM, ROM, EEPROM, CD-ROM or other optical disk storage, magnetic disk storage or other magnetic storage devices, or any other storage medium which may be used to carry or store one or more desired programs having program code in the form of computer-executable instructions or data structures and which may be accessed and executed by a general-purpose computer, special-purpose computer, or virtual computer such as a virtual machine. Combinations of the above may also be included within the scope of computer-readable media.

Computer-executable instructions comprise, for example, instructions and data which, when executed by one or more processors, cause a general-purpose computer, special-purpose computer, or virtual computer such as a virtual machine to perform a certain method, function, or group of methods or functions. Although the subject matter has been described in language specific to structural features and/or methodological steps, it is to be understood that the subject matter defined in the appended claims is not necessarily limited to the specific features or steps described above. Rather, the specific features and steps described above are disclosed as example forms of implementing the claims.

As used herein, the term "program" may refer to software objects or routines that execute on a computing system. The different programs described herein may be implemented as objects or processes that execute on a computing system (e.g., as separate threads). While the GUIs described herein are preferably implemented in software, implementations in hardware or a combination of software and hardware are also possible and contemplated.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A sewing machine comprising:

a frame;

a needle bar configured to have a needle threaded with a thread;

a motor configured to cause the needle bar to reciprocate the needle with respect to the frame and into and out of a fabric;

a first sensor configured to emit first electromagnetic radiation at a first frequency, that is in the range of visible light having a first color, in order to sense movement of the fabric relative to the frame or of the frame relative to the fabric;

a second sensor configured to emit second electromagnetic radiation at a second frequency, that is different from the first frequency and that is in the range of visible light having a second color, in order to sense movement of the fabric relative to the frame or of the frame relative to the fabric; and a processor configured to:

control a speed of the motor in order to control a speed of the needle reciprocating into and out of the fabric;

determine a translational movement of the fabric relative to the frame, or of the frame relative to the fabric, based on the sensed movement of one or more of the first sensor or the second sensor; and in response to the determined translational movement, alter the speed of the motor in order to alter the speed of the needle reciprocating into and out of the fabric.

2. The sewing machine of claim 1, wherein:

the first sensor is configured to sense movement of the fabric relative to the frame, or of the frame relative to the fabric, while the first sensor is positioned above the fabric; and the second sensor is configured to sense movement of the fabric relative to the frame, or of the frame relative to the fabric, while the second sensor is positioned above the fabric.

3. The sewing machine of claim 1, wherein:

the first sensor is configured to sense movement of the fabric relative to the frame, or of the frame relative to the fabric, while the first sensor is positioned below the fabric; and the second sensor is configured to sense movement of the fabric relative to the frame, or of the frame relative to the fabric, while the second sensor is positioned below the fabric.

4. The sewing machine of claim 1, wherein:

the first sensor is configured to sense movement of the fabric relative to the frame, or of the frame relative to the fabric, while the first sensor is positioned above the fabric; and the second sensor is configured to sense movement of the fabric relative to the frame, or of the frame relative to the fabric, while the second sensor is positioned below the fabric.

5. The sewing machine of claim 1, wherein the frame of the sewing machine is configured to remain stationary during sewing.

6. The sewing machine of claim 1, wherein:

the frame of the sewing machine is configured to be repositioned during sewing;

the sewing machine is a long-arm quilting machine;

the sewing machine further comprises handle bars attached to the frame;

the sewing machine further comprises a presser bar having a hopping foot attached thereto; and the motor is further configured to cause the presser bar to reciprocate the hopping foot onto and off of the fabric.

7. A sewing machine comprising:

a frame;

a needle bar configured to have a needle threaded with a thread;

a motor configured to cause the needle bar to reciprocate the needle with respect to the frame and into and out of a fabric;

first and third sensors configured to emit first electromagnetic radiation at a first frequency that is in the range of visible light having a first color, in order to sense movement of the fabric relative to the frame or of the frame relative to the fabric;

second and fourth sensors configured to emit second electromagnetic radiation at a second frequency, that is different from the first frequency and that is in the range of visible light having a second color, in order to sense movement of the fabric relative to the frame or of the frame relative to the fabric; and a processor configured to:

control a speed of the motor in order to control a speed of the needle reciprocating into and out of the fabric;

determine a translational movement of the fabric relative to the frame, or of the frame relative to the fabric, based on the sensed movement of one or more of the first sensor, the second sensor, the third sensor, or the fourth sensor;

determine a rotational movement of the fabric relative to the frame, or of the frame relative to the fabric, based on the sensed movement of the first sensor and of the third sensor, based on the sensed movement of the second sensor and of the fourth sensor, or based on the sensed movement of the first sensor and of the third sensor and on the sensed movement of the second sensor and of the fourth sensor; and in response to the determined translational movement and the determined rotational movement, alter the speed of the motor in order to alter the speed of the needle reciprocating into and out of the fabric.

8. The sewing machine of claim 7, wherein:

each of the first sensor and the third sensor is configured to sense movement of the fabric relative to the frame, or of the frame relative to the fabric, while positioned above the fabric; and each of the second sensor and the fourth sensor is configured to sense movement of the fabric relative to the frame, or of the frame relative to the fabric, while positioned above the fabric.

9. The sewing machine of claim 7, wherein:

each of the first sensor and the third sensor is configured to sense movement of the fabric relative to the frame, or of the frame relative to the fabric, while positioned below the fabric; and each of the second sensor and the fourth sensor is configured to sense movement of the fabric relative to the frame, or of the frame relative to the fabric, while positioned below the fabric.

10. The sewing machine of claim 7, wherein:

each of the first sensor and the second sensor is configured to sense movement of the fabric relative to the frame, or of the frame relative to the fabric, while positioned above the fabric; and each of the third sensor and the fourth sensor is configured to sense movement of the fabric relative to the frame, or of the frame relative to the fabric, while positioned below the fabric.

11. The sewing machine of claim 7, wherein the frame of the sewing machine is configured to remain stationary during sewing.

12. The sewing machine of claim 7, wherein:

the frame of the sewing machine is configured to be repositioned during sewing;

the sewing machine is a long-arm quilting machine;

the sewing machine further comprises handle bars attached to the frame;

the sewing machine further comprises a presser bar having a hopping foot attached thereto; and the motor is further configured to cause the presser bar to reciprocate the hopping foot onto and off of the fabric.

13. A sewing machine comprising:

a frame;

a needle bar configured to have a needle threaded with a thread;

a motor configured to cause the needle bar to reciprocate the needle with respect to the frame and into and out of a fabric;

a first sensor configured to emit first electromagnetic radiation at a first frequency, that is in the range of visible light, in order to sense movement of the fabric relative to the frame or of the frame relative to the fabric;

a second sensor configured to emit second electromagnetic radiation at a second frequency, that is different from the first frequency and that is not in the range of visible light, in order to sense movement of the fabric relative to the frame or of the frame relative to the fabric; and a processor configured to:

control a speed of the motor in order to control a speed of the needle reciprocating into and out of the fabric;

determine a translational movement of the fabric relative to the frame, or of the frame relative to the fabric, based on the sensed movement of one or more of the first sensor or the second sensor; and in response to the determined translational movement, alter the speed of the motor in order to alter the speed of the needle reciprocating into and out of the fabric.

14. The sewing machine of claim 13, wherein:

the first sensor is configured to sense movement of the fabric relative to the frame, or of the frame relative to the fabric, while the first sensor is positioned above the fabric; and the second sensor is configured to sense movement of the fabric relative to the frame, or of the frame relative to the fabric, while the second sensor is positioned above the fabric.

15. The sewing machine of claim 13, wherein:

the first sensor is configured to sense movement of the fabric relative to the frame, or of the frame relative to the fabric, while the first sensor is positioned below the fabric; and the second sensor is configured to sense movement of the fabric relative to the frame, or of the frame relative to the fabric, while the second sensor is positioned below the fabric.

16. The sewing machine of claim 13, wherein:

the first sensor is configured to sense movement of the fabric relative to the frame, or of the frame relative to the fabric, while the first sensor is positioned above the fabric; and the second sensor is configured to sense movement of the fabric relative to the frame, or of the frame relative to the fabric, while the second sensor is positioned below the fabric.

17. The sewing machine of claim 13, wherein the frame of the sewing machine is configured to remain stationary during sewing.

18. The sewing machine of claim 13, wherein:

the frame of the sewing machine is configured to be repositioned during sewing;

the sewing machine is a long-arm quilting machine;

the sewing machine further comprises handle bars attached to the frame;

the sewing machine further comprises a presser bar having a hopping foot attached thereto; and the motor is further configured to cause the presser bar to reciprocate the hopping foot onto and off of the fabric.

19. A sewing machine comprising:

a frame;

a needle bar configured to have a needle threaded with a thread;

a motor configured to cause the needle bar to reciprocate the needle with respect to the frame and into and out of a fabric;

first and third sensors configured to emit first electromagnetic radiation at a first frequency, that is in the range of visible light, in order to sense movement of the fabric relative to the frame or of the frame relative to the fabric;

second and fourth sensors configured to emit second electromagnetic radiation at a second frequency, that is different from the first frequency and that is not in the range of visible light, in order to sense movement of the fabric relative to the frame or of the frame relative to the fabric; and a processor configured to:

control a speed of the motor in order to control a speed of the needle reciprocating into and out of the fabric;

determine a translational movement of the fabric relative to the frame, or of the frame relative to the fabric, based on the sensed movement of one or more of the first sensor, the second sensor, the third sensor, or the fourth sensor;

determine a rotational movement of the fabric relative to the frame, or of the frame relative to the fabric, based on the sensed movement of the first sensor and of the third sensor, based on the sensed movement of the second sensor and of the fourth sensor, or based on the sensed movement of the first sensor and of the third sensor and on the sensed movement of the second sensor and of the fourth sensor; and in response to the determined translational movement and the determined rotational movement, alter the speed of the motor in order to alter the speed of the needle reciprocating into and out of the fabric.

20. The sewing machine of claim 19, wherein:

each of the first sensor and the third sensor is configured to sense movement of the fabric relative to the frame, or of the frame relative to the fabric, while positioned above the fabric; and each of the second sensor and the fourth sensor is configured to sense movement of the fabric relative to the frame, or of the frame relative to the fabric, while positioned above the fabric.

21. The sewing machine of claim 19, wherein:

each of the first sensor and the third sensor is configured to sense movement of the fabric relative to the frame, or of the frame relative to the fabric, while positioned below the fabric; and each of the second sensor and the fourth sensor is configured to sense movement of the fabric relative to the frame, or of the frame relative to the fabric, while positioned below the fabric.

22. The sewing machine of claim 19, wherein:

each of the first sensor and the second sensor is configured to sense movement of the fabric relative to the frame, or of the frame relative to the fabric, while positioned above the fabric; and each of the third sensor and the fourth sensor is configured to sense movement of the fabric relative to the frame, or of the frame relative to the fabric, while positioned below the fabric.

23. The sewing machine of claim 19, wherein the frame of the sewing machine is configured to remain stationary during sewing.

24. The sewing machine of claim 19, wherein:

the frame of the sewing machine is configured to be repositioned during sewing;

the sewing machine is a long-arm quilting machine;

the sewing machine further comprises handle bars attached to the frame;

the sewing machine further comprises a presser bar having a hopping foot attached thereto; and the motor is further configured to cause the presser bar to reciprocate the hopping foot onto and off of the fabric.

* * * * *